US007648097B2

(12) United States Patent
Cattacin et al.

(10) Patent No.: US 7,648,097 B2
(45) Date of Patent: Jan. 19, 2010

(54) DISPENSER CONTAINING SIDE BY SIDE ROLLS AND PROVIDED WITH LOWER SLIDING CLOSING MEANS

(75) Inventors: Gilles Cattacin, Colmar (FR); Nicolas Pommier, Colmar (FR); Philippe Cador, Montmorot (FR)

(73) Assignee: Georgia-Pacific France (FR)

( * ) Notice: Subject to any disclaimer, the term of this patent is extended or adjusted under 35 U.S.C. 154(b) by 41 days.

(21) Appl. No.: 11/956,698

(22) Filed: Dec. 14, 2007

(65) Prior Publication Data

US 2008/0156926 A1 Jul. 3, 2008

(30) Foreign Application Priority Data

Dec. 27, 2006 (FR) ..... 06 11455

(51) Int. Cl.
*B65H 67/00* (2006.01)
*B65H 16/04* (2006.01)

(52) U.S. Cl. ..... 242/560; 242/597.4; 242/597.8

(58) Field of Classification Search ..... 242/560, 242/560.2, 597, 597.4, 597.8, 596.6, 596.8, 242/599.3, 594, 594.5, 594.6
See application file for complete search history.

(56) References Cited

U.S. PATENT DOCUMENTS 4,872,601 A * 10/1989 Sigmund ..... 225/38
5,265,816 A 11/1993 Collins
5,645,244 A * 7/1997 Moody ..... 242/422.5
5,954,256 A * 9/1999 Niada ..... 225/34
6,036,134 A * 3/2000 Moody ..... 242/422.4
6,364,245 B1 * 4/2002 Paal et al. ..... 242/560
6,959,891 B2 * 11/2005 Kapiloff et al. ..... 242/597.8
7,219,852 B2 * 5/2007 Tramontina et al. ..... 242/422.5
7,422,174 B2 * 9/2008 Elliott et al. ..... 242/597.5

FOREIGN PATENT DOCUMENTS

EP 0837645 11/1997
EP 1033100 A2 9/2000
EP 1559357 A2 8/2005
GB 2400362 A 10/2004

OTHER PUBLICATIONS

Search report, FR 0611455, dated Jul. 23, 2007.

* cited by examiner

*Primary Examiner*—Evan H Langdon
(74) *Attorney, Agent, or Firm*—Joel T. Charlton

(57) ABSTRACT

The invention relates to a dispenser of rolls placed side by side, each held in rotation about a horizontal spindle (1), comprising a casing (10) surrounding the rolls, a cover (14) that complements the casing, at least one opening (2) in the lower part of the dispenser, and a sliding access panel (3) intended to partially close off the said opening so as to allow access to one of the rolls known as the roll in use, and at the same time, prevent access to the other roll known as the spare roll contained in the dispenser. According to the invention, the dispenser further comprises a mechanism intended to immobilize the access panel (3) under the spare roll and release it automatically and only when the roll in use is empty.

19 Claims, 4 Drawing Sheets

DISPENSER CONTAINING SIDE BY SIDE ROLLS AND PROVIDED WITH LOWER SLIDING CLOSING MEANS

This application claims priority to copending French patent application number 06 11455, filed Dec. 27, 2006, the disclosure of which is incorporated herein by reference.

The invention relates to the field of dispensers of rolls of one-use paper such as toilet paper, wipers, hand-towels, kitchen roll, etc.

More specifically, the dispensers at which the invention is aimed may contain two (or more than two) rolls placed side by side and are fastened to a wall; one of the rolls known as the roll in use is paid out from the bottom of the dispenser via an opening provided for that purpose while the other roll or rolls known as the spare roll or rolls are protected by the casing of the dispenser and by a bottom element, for example, a sliding access panel.

With this type of dispenser, particularly in use in communal areas, in public places, it is necessary to provide equipment that is simple to use, to operate and to maintain, and which is hygienic, that is to say which affords the rolls good protection from the external environment which may sometimes be hostile.

Furthermore, refilling with rolls and maintenance need to be simplified as far as possible so as to reduce maintenance time.

Furthermore, this type of dispenser needs to allow the user to have a supply of paper even when numerous dispensing operations have been performed already and/or when refilling is infrequent.

Of necessity, the dispenser needs to safeguard the so-called spare roll or rolls as much as possible.

Two-roll horizontal dispensers that fulfil the abovementioned objectives fairly satisfactorily already exist.

European Patent Application EP 0 837 645 illustrates a two-roll dispenser in which a protective element in the form of an arc of a circle is able to close off part of the opening of the dispenser, in vertical alignment with one of the rolls, particularly when the other roll is empty. However, the protective element disclosed in this prior art protects just one of the two so-called spare rolls and no switching of roll location or symmetry of operation of the two roll locations is anticipated.

In other known dispensers, a movable closing-off flap is provided at the opening near the bottom of the dispenser. Documents U.S. Pat. No. 5,265,816 or alternatively GB 2 400 362 disclose dispensers of this type, in which a panel (or flap) can slide at the bottom in order to partially close off the opening thereof.

These access panels can be moved by hand by the user once the roll in use is empty, by virtue of the fact that a vertical element connected to the flap is then free to be moved. This vertical element, which can also act as a protective flap to protect a part of the so-called spare roll, is actually immobilized by the roll in use as long as the latter is not empty.

In any case, it is the responsibility of the user to initiate the movement of the access panel, and accidents may occur if excessive force is exerted on the access panel because there is no real safety measure surrounding this. There is no sure immobilization of the flap and more importantly, nor is there any sure unlocking, that is to say any unlocking that is allowed only when the roll in use is truly and completely empty.

There is therefore a need for a dispenser that is at once simple, reliable, and improves the features of the known dispensers of the prior art.

Thus, a subject of the present invention is a dispenser of rolls placed side by side, each held in rotation about a horizontal spindle, comprising a casing surrounding the rolls, a cover of a shape that complements that of the casing, at least one opening in the lower part of the dispenser, and a sliding access panel intended to partially close off the said opening so as to allow access to one of the rolls known as the roll in use, and at the same time, prevent access to the other roll known as the spare roll contained in the dispenser.

According to the invention, the dispenser further comprises a mechanism intended to immobilize the access panel in vertical alignment with the spare roll and release it automatically and only when the roll in use is empty.

Advantageously, the immobilizing mechanism allows the access panel to be unlocked to allow it to move towards either one of the sites of the rolls.

More specifically, the mechanism comprises lugs connected to the sliding access panel, each lug collaborating with at least one end stop of an element mounted so that it can pivot about a vertical axis under the effect of a return element positioned in the back of the casing.

This a mechanical means that is both simple and reliable, and therefore highly advantageous particularly for dispensers located in public places, that are used both frequently and sometimes roughly.

According to a preferred embodiment of the invention, the dispenser is designed to contain two rolls at the same time.

Furthermore, the dispenser according to the invention may comprise two pivoting elements, each one associated with one roll.

According to one of the embodiments of the invention, the elements for axially holding the rolls are of the barbed hook type and the rolls have no central core.

More precisely, each pivoting element comprises an end stop positioned at a first end; the return element collaborates directly with the second end of the pivoting element.

Furthermore, each support spindle is fixed to the back of the casing and passes through the pivoting element at its second end.

Advantageously, the dispenser comprises a cover having at least one convex shape facing towards the inside of the dispenser and complementing a concave shape formed in a flank of at least one of the rolls.

Without departing from the scope of the invention, the dispenser further comprises at least one flap for protecting a spare roll.

The invention, its features, and its advantages will be better understood with the aid of the description that will follow, given by way of entirely non-limiting illustration with reference to the attached drawings in which.

Figure 1:
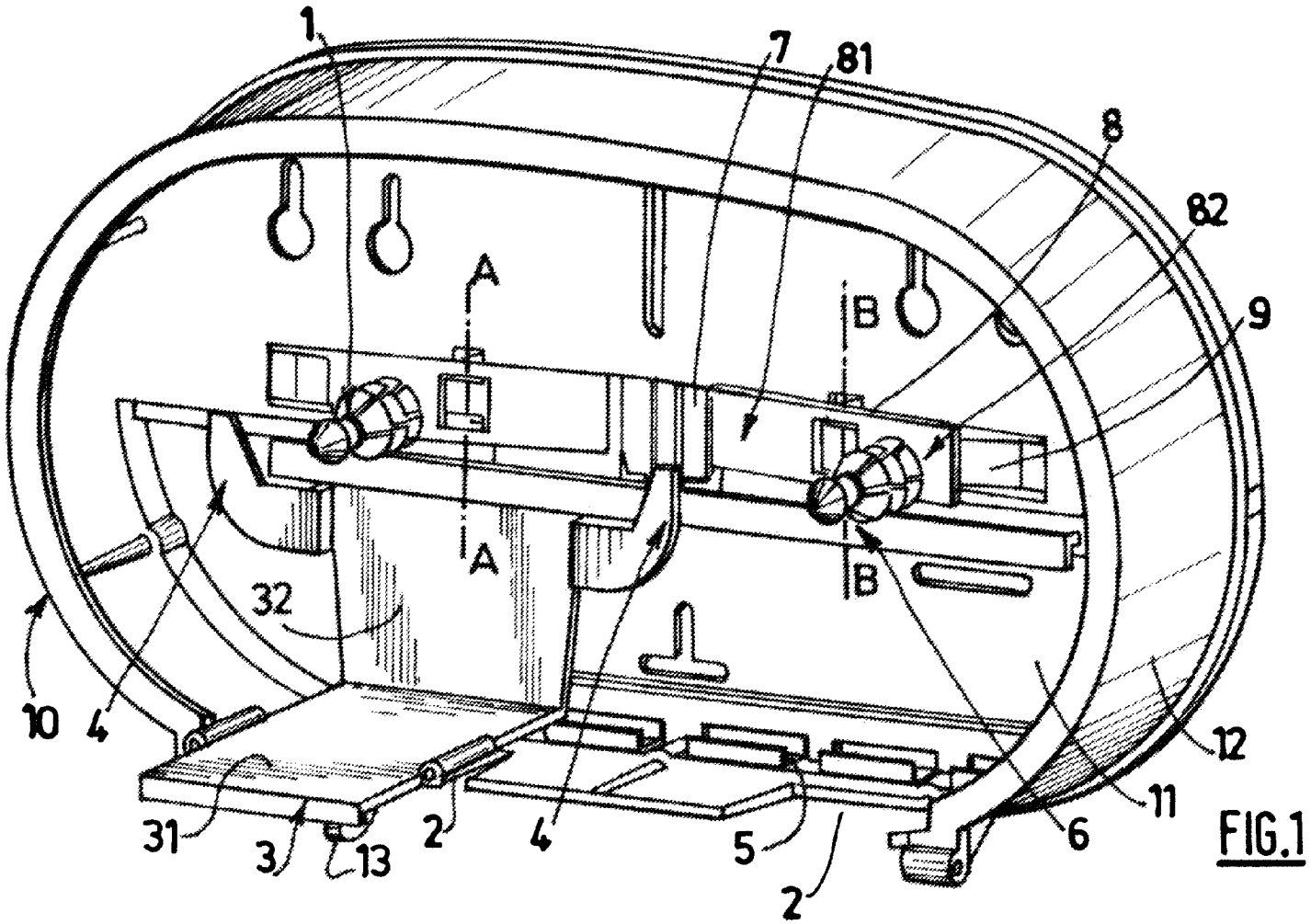
FIG. 1 is a diagram of the inside of a dispenser according to the invention.

The dispenser partially depicted in FIG. 1 is able to contain two rolls (not depicted) placed side by side, each held around a horizontal spindle 1 free to rotate and perpendicular to the vertical wall (not depicted) to which the dispenser is attached.

As a preference, the spindle 1 is in the form of a barbed hook, that is to say formed of inclined fins that allow a roll to be inserted easily, but then prevented from being removed from the support spindle 1. According to this embodiment, the rolls have no central core and the support spindles 1 are therefore pushed directly through the axis of the roll.

The casing 10 may have any appropriate shape capable of containing the rolls concerned and safeguarding them against the surroundings: according to FIG. 1, it has a back wall 11 intended to be placed in contact with the wall to which the dispenser is attached.

A wall 12 of rectangular overall shape and bent into an elliptical shape delimits an external outline, the width of which is similar to the width of the rolls that are to be contained. The wall 12 at its lower part has as many apertures 2 as the dispenser is liable to contain rolls. Each aperture 2, positioned in vertical alignment with each roll, therefore represents a potential outlet for the paper that is to be paid out.

Furthermore, a sliding access panel 3 is provided to close off at least one opening 2. Without departing from the scope of the invention, the access panel 3 may close off part of the single bottom opening 2 if the latter is positioned under all the rolls.

Advantageously, the access panel 3 covers the lower surface corresponding to one roll and at the same time, allows access to a roll known as the roll in use, that is to say the one directly accessible to and that can be paid out by the user.

The access panel 3 can be slid by the force exerted by the user.

According to the invention, the access panel 3 is in the form of two planes 31, 32 positioned at right angles, one of them horizontal 31, and the other vertical 32; the horizontal plane 31 covers the aperture 2 and the vertical plane 32 bears lugs 4 belonging to the mechanism for immobilizing the access panel 3.

Here, the access panel 3 is guided in translational movement by rails 5 positioned in the lower part of the casing 10 and collaborating, for example, with an end stop; a second guide rail 6 may be provided to collaborate with retaining elements (not depicted) that retain the vertical plane 32 at its top.

Any other means of guiding and holding the access panel 3 with respect to the casing 10 may be envisaged without departing from the scope of the invention.

The access panel 3 comprises two lugs 4 positioned at the upper part of the vertical plane 32, and generally vertical. The lugs 4 collaborate with at least one end stop 7 forming part of an element 8 mounted so that it can pivot about a vertical axis (AA; BB). The pivoting element 8 has the overall shape of a rectangular plate with a vertical axis of rotation (AA, BB) at its middle. The end stop 7 is positioned at a first end 81 of the plate 8 while the horizontal roll-holding spindle, fixed into the back 11 of the casing 10, passes through the second end 82 of the pivoting element 8 via an orifice. At the second end 82, the pivoting element collaborates with a return element 9 that returns it to bearing against the back 11 of the casing 10 and tends to push the second end 82 forwardly inside of the casing 10.

The return element 9 may consist of a flexible leaf or of a compression spring or may form part of the second end 82 of the pivoting element. In the latter solution, the return element is moulded directly as an integral part of the pivoting element 8.

Figure 2:
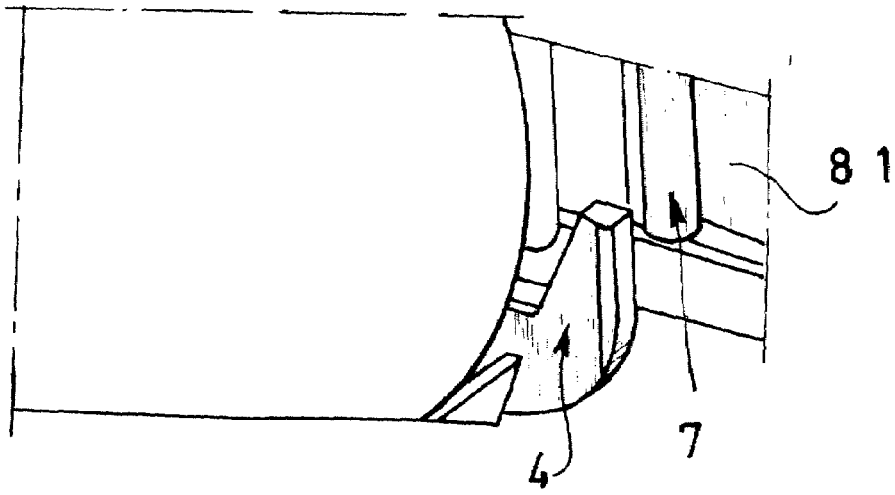
FIG. 2 is an enlarged view of part of the system for immobilizing the access panel in a first position.

FIG. 2 shows the immobilizing and automatic unlocking mechanism according to the invention in greater detail.

A lug 4 borne by the access panel 3 is depicted here in the unlocked position with respect to the end stop 7 positioned to the right in the figure. The lug 4 is not in contact with this end stop.

When a roll (R) is placed and pushed on to a support spindle 1, one of its flanks pushes the end 82 of the pivoting element 8 towards the back wall 11 of the casing 10, against the action of the force exerted by the return element 9.

Thus, the pivoting element 8 collaborating with a "full" roll engaged on the support spindle 1 has its second end 82 "pushed in" and its first end 81 protruding into the casing. The end stop 7 positioned on the first end 81 thus acts as a stop for the lug 4.

When two full rolls are each placed on a support spindle 1, the two end stops 7 are positioned such that they protrude, thus immobilizing a lug 4 in the middle of the dispenser.

When one of the rolls (R) is not (or is no longer) pushed on to its support spindle 1, the element 8 pivots about its vertical axis (AA, BB) under the effect of the return element 9 so that the first end 81 and the associated end stop 7 are pushed in towards the back wall 11, no longer constituting an end stop for the lug 4.

Here, there is automatic unlocking of this lug and therefore of the access panel 3 which can then slide towards the empty roll, wherever it is located (to the right or to the left in the dispenser).

As a result, the access panel 3 can be moved towards the location of the empty roll, thus uncovering the outlet 2 in vertical alignment with a full roll which then becomes the so-called roll in use.

This mechanical arrangement therefore makes it possible to immobilize the access panel 3 under a spare roll until such time as the other roll, known as the roll in use, is empty, then allows the access panel 3 to be released automatically only when the roll in use is empty.

Particularly advantageously, the function of releasing the access panel 3 is performed symmetrically, that is to say irrespective of the location of the empty roll; in other words, the access panel 3 slides either to the right or to the left, always towards the location of an empty roll. That makes it possible to increase the time between refills of the dispenser one roll must be fully depleted before users gain access to the other.

Figure 3:
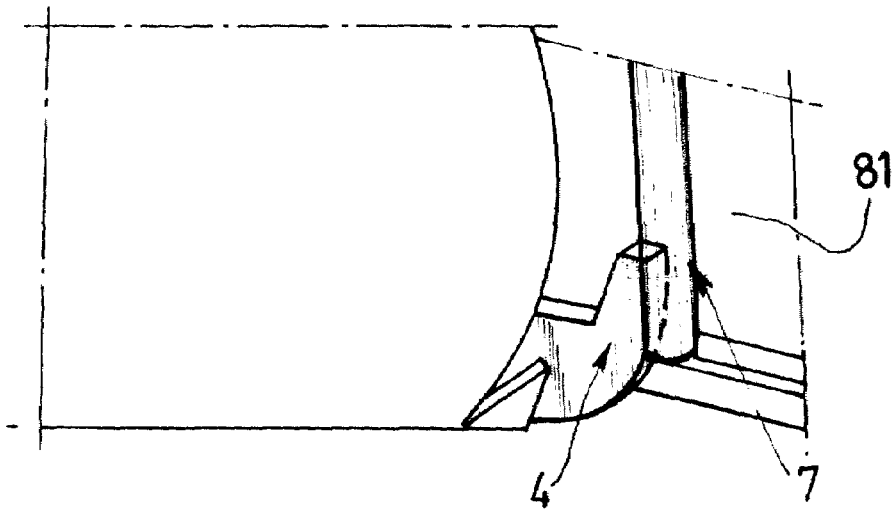
FIG. 3 is an enlarged view of part of the system for immobilizing the access panel in a second position.

FIG. 3 schematically shows the respective positions of the lug 4 and of the end stop 7 in the immobilizing position.

A handle 13 may be provided on one side of the horizontal plane 31 outside the casing 10.

As can be readily seen from FIG. 1, the access panel 3 comprises two lugs 4 positioned at each of the top ends of the vertical plane 32 thus making the system reversible so that it works the same way irrespectively of which location is accommodating the empty roll in the dispenser.

Figure 4:
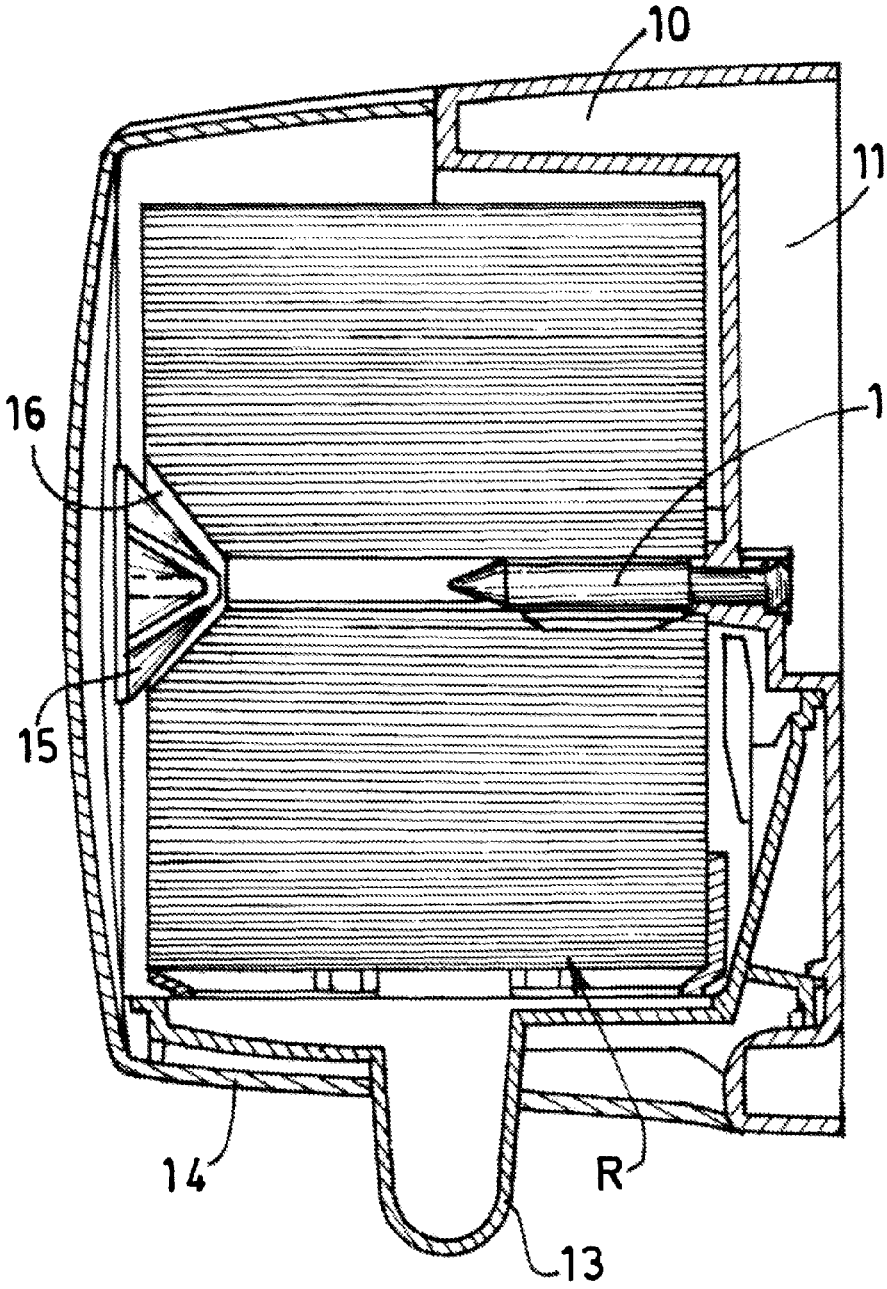
FIG. 4 is a vertical section along one of the axes of rotation of a roll, of one particular embodiment of the invention.

FIG. 4 is a "transverse" section through the dispenser, on a vertical plane passing through the support spindle 1 of one of the rolls.

It is also possible to make out the back 11 of the dispenser, a support spindle 1 for a roll R and, at the front, the cover 14 whose shape, which complements that of the casing 10, protects the rolls from the external surroundings.

According to one embodiment of the invention, the cover 14 comprises a protruding element 15 (or protrusion) protruding towards the inside of the dispenser.

This element may, for example, be conical, the vertex of the cone being directed towards the inside of the dispenser and collaborating with a depression 16 in the flank of the roll.

The respective external shapes of the element 15 and of the deformation 16 may be any shape but they need to complement one another so as to allow the cover 14 to close correctly over the roll R.

This particular arrangement makes it possible to render the system captive because a standard roll, that is to say one with no special depression 16, prevents the cover 14 from being fully closed over the casing 10.

It is possible to provide a protruding element 15 for each roll location, or alternatively for just one of the rolls R.

Figure 5:
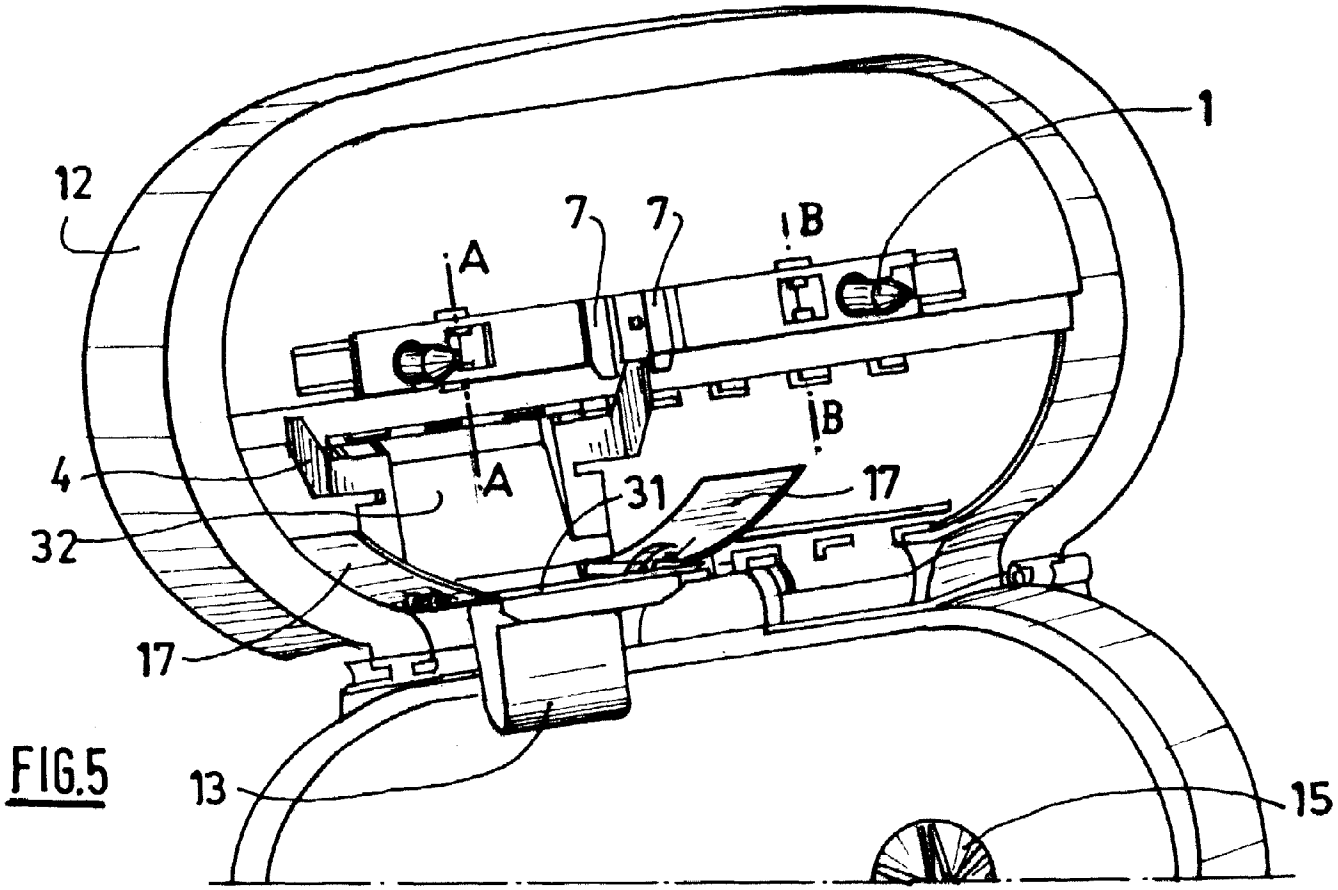
FIG. 5 is a diagram of the inside of a dispenser according to another embodiment of the invention.

Finally, in order to enhance the protection of the so-called spare roll R under which the access panel 3 is immobilized, protective flaps 17 may be provided as illustrated in FIG. 5. The flaps 17 may be of curved shape, each one connected by an element of the hinge type, to the horizontal plane 31 of the access panel 3. The flaps 17, in the form of portions of a cylinder, are positioned around the so-called spare roll in order in particular to guarantee that it remains hygienic and safeguard the spare roll, preventing the user from gaining access to and therefore from touching the said roll while it is in the "spare" position. The hinge-type element may consist of a torsion spring.

The torsion springs allow the flaps 17 to be returned automatically around the spare roll wherever the latter is located.

The invention claimed is:

1. A dispenser for rolls of sanitary tissue comprising:

a casing, first and second horizontal spindle means for holding a first roll of tissue and a second roll of tissue rotatably about each of said spindles, said spindles being adapted for placing said rolls side by side, said casing surrounding the spindles, a cover having a shape that complements that of the casing, at least one opening being defined in the lower part of the dispenser, a sliding access panel, slideable to at least partially close off said one opening, allowing access to a roll placed on said first spindle, and at the same time, preventing access to a roll placed on the second spindle, and restraining means for immobilizing the sliding access panel in vertical alignment with the second spindle in the presence of a roll on the first spindle and automatically releasing it in the absence of a roll on the first spindle, comprising:

at least one lug operably connected to said sliding access panel, a pivotable roll detection element pivotable about a vertical axis and having at least one end stop formed therein, and a return element means positioned rearwardly within said casing for:

urging said pivotable roll detection element into restraining engagement with said lug in the presence of an undepleted roll on said first spindle; and restraining sliding of said sliding access panel in the presence of an undepleted roll on said first spindle.

2. The dispenser according to claim 1, wherein each said spindle comprises at least one hook for axially holding a coreless roll thereupon.

3. The dispenser according to claim 1, wherein said casing is configured to contain two rolls at the same time.

4. The dispenser according to claim 3, wherein each said spindle comprises at least one hook for axially holding a coreless roll thereupon.

5. The dispenser according to claim 1, further comprising a pivotable roll detection element associated with each spindle, each detection element being pivotable about a vertical axis, and each detection element being adapted to detect the presence of an undepleted roll upon its associated spindle.

6. A dispenser according to claim 5, characterized in that each pivotable roll detection element comprises an end stop positioned at a first end thereof.

7. The dispenser according to claim 6, wherein said casing further comprises a back, characterized in that each spindle means is fixed to the back of the casing and passes through its associated pivotable roll detection element at an end thereof spaced away from its end stop.

8. The dispenser according to claim 7, further comprising at least one flap attached to said sliding access panel for blocking access to a roll mounted on said second spindle.

9. The dispenser according to claim 1, characterized in that the restraining means allows the sliding access panel to be unlocked to allow it to move toward either one of the spindles.

10. The dispenser according to claim 9, wherein said casing is configured to contain two rolls at the same time.

11. The dispenser according to claim 9, wherein each said spindle comprises at least one hook for axially holding a coreless roll thereupon.

12. The dispenser according to claim 11, further comprising a pivotable roll detection element associated with each spindle, each being adapted to detect the presence of an undepleted roll upon its associated spindle.

13. The dispenser according to claim 12, characterized in that each pivotable roll detection element comprises an end stop positioned at a first end thereof.

14. The according to claim 13, wherein said casing further comprises a back, characterized in that each spindle means is fixed to the back of the casing and passes through its associated pivotable roll detection element at an end thereof spaced away from its end stop.

15. The dispenser according to claim 14, further comprising at least one flap attached to said sliding access panel for blocking access to a roll mounted on said second spindle.

16. The dispenser according claim 13, wherein said dispenser is adapted to receive rolls having a convex shape formed into a flank thereof, characterized in that the cover has at least one convex shape formed therein facing towards the inside of the dispenser and adapted to engage the complementary concave shape formed in a flank a roll mounted on said spindles.

17. The dispenser according to claim 16, further comprising at least one flap attached to said sliding access panel for blocking access to a roll mounted on said second spindle.

18. The dispenser according to claim 1, wherein the pivotal roll detection element comprises:

a vertical pivot axis operably connected with said casing;

a first arm on one side of said vertical pivot axis; and a second arm on an opposite side of said vertical pivot axis;

wherein said end stop is disposed on said first arm and said first spindle is disposed on said second arm;

wherein in response to the presence of an undepleted roll on said first spindle, said second arm is urged toward the back of said casing against a bias of said return element, and said first arm is urged toward the front of said casing in restraining engagement with said lug, thereby restraining sliding of said sliding access panel in the presence of an undepleted roll on said first spindle.

19. The dispenser according to claim 1, wherein said pivotal roll detection element is disposed in a first position in response to the absence of a roll on said first spindle, and is disposed in a second position in response to the presence of an undepleted roll on said first spindle, wherein said first position permits sliding of said sliding access panel and said second position restrains sliding of said sliding access panel.

* * * * *